US008061575B2

(12) United States Patent
Joyce et al.

(10) Patent No.: US 8,061,575 B2
(45) Date of Patent: Nov. 22, 2011

(54) STAPLER WITH LEAF SPRING ACTUATION MECHANISM

(75) Inventors: Michael P. Joyce, Kinnelon, NJ (US); Brent Lucas, Leonardo, NJ (US)

(73) Assignee: Quad III, Inc., Kinnelon, NJ (US)

( * ) Notice: Subject to any disclaimer, the term of this patent is extended or adjusted under 35 U.S.C. 154(b) by 0 days.

(21) Appl. No.: 11/483,886

(22) Filed: Jul. 10, 2006

(65) Prior Publication Data

US 2006/0249555 A1 Nov. 9, 2006

Related U.S. Application Data

(63) Continuation of application No. 11/009,369, filed on Dec. 10, 2004, now Pat. No. 7,097,086.

(51) Int. Cl.
*B25C 5/11* (2006.01)

(52) U.S. Cl. ..... 227/132; 227/120; 227/134

(58) Field of Classification Search ..... 227/120, 227/130, 132, 134
See application file for complete search history.

(56) References Cited

U.S. PATENT DOCUMENTS

| | | | | |
|---|---|---|---|---|
| 3,593,904 | A | 7/1971 | Gaya | |
| 3,630,428 | A | 12/1971 | Olney | |
| 3,958,738 | A | 5/1976 | Tremblay | |
| 4,182,474 | A | 1/1980 | Sato | |
| 4,288,019 | A | 9/1981 | Dahle | |
| 4,399,938 | A | 8/1983 | Biddle | |
| 4,452,388 | A | 6/1984 | Fealey | |
| 4,463,890 | A | 8/1984 | Ruskin | |
| 5,165,587 | A | 11/1992 | Marks | |
| 5,335,838 | A | 8/1994 | Harris et al. | |
| 5,335,839 | A | 8/1994 | Fealey | |
| 5,356,063 | A | 10/1994 | Perez | |
| 5,407,118 | A | 4/1995 | Marks | |
| 5,497,932 | A | 3/1996 | Brewer et al. | |
| 5,511,716 | A | 4/1996 | Marks | |
| 5,664,722 | A | 9/1997 | Marks | |
| 5,699,949 | A | 12/1997 | Marks | |
| 5,816,470 | A | 10/1998 | Plato et al. | |
| 5,979,736 | A | 11/1999 | Edehot | |
| 5,988,478 | A | 11/1999 | Marks | |
| 6,145,728 | A | 11/2000 | Marks | |
| 6,789,719 | B2 | 9/2004 | Shor | |
| 6,918,525 | B2 | 7/2005 | Marks | |
| 7,097,088 | B2 * | 8/2006 | Shor | 227/132 |
| 7,243,832 | B2 * | 7/2007 | Jiang | 227/120 |
| 7,387,227 | B1 * | 6/2008 | Jiang et al. | 227/8 |
| 7,823,759 | B2 * | 11/2010 | Jiang | 227/132 |

* cited by examiner

*Primary Examiner* — Rinaldi Rada
*Assistant Examiner* — Gloria R Weeks
(74) *Attorney, Agent, or Firm* — Sorin Royer Cooper LLC

(57) ABSTRACT

The present invention provides a stapler with a novel leaf spring actuation mechanism. According to the teaching of the present invention, the stapler comprises a striking plate for dispensing a staple from a staple magazine, a leaf spring engaged with the striking plate for driving the striking plate, and an actuation bar for lifting the leaf spring from a first position to a second position whereby lifting the striking plate from an initial position to a release position in which the leaf spring is released from the actuation bar to drive the striking plate towards the initial position. Preferably, a pair of lugs on the actuation bar pushes up a pair of tabs on the leaf spring when an L-shaped front end of the actuation bar moves upward along a ramp when an external force is applied to the actuation bar during the stapling operation.

4 Claims, 6 Drawing Sheets

STAPLER WITH LEAF SPRING ACTUATION MECHANISM

CROSS REFERENCE TO RELATED APPLICATIONS

This application is a continuation application and to U.S. patent application Ser. No. 11/009,369, filed Dec. 10, 2004 now U.S. Pat. No. 7,097,086, entitled "Stapler With Leaf Spring Actuation Mechanism" now allowed, the entire disclosure of which is hereby incorporated by reference.

FIELD OF THE INVENTION

The present invention relates to a stapling apparatus, and more particularly, to a spring activated stapler with a simple leaf spring actuation mechanism.

BACKGROUND OF THE INVENTION

In a spring-actuated stapler, when an external force is applied to the stapler (usually by pressing a cover of the stapler), a spring element is loaded, and at the same time a striking plate is moved from an initial position to a release position. When the striking plate arrives at the release position, the spring element is unloaded to powerfully drive the striking plate from the release position back to the initial position to individually dispense a staple from a staple magazine.

There are numerous spring actuation mechanisms to carry out the above operations, however, efforts have never stopped in designing better ones with improvement in simplicity, preciseness and reliability.

SUMMARY OF THE INVENTION

The present invention provides a stapler with a novel leaf spring actuation mechanism. According to the teaching of the present invention, the stapler comprises a striking plate for dispensing a staple from a staple magazine, a leaf spring engaged with the striking plate for driving said striking plate, and an actuation bar for lifting the leaf spring from a first position to a second position whereby lifting the striking plate from an initial position to a release position in which the leaf spring is released from the actuation bar to powerfully drive the striking plate towards the initial position.

In a preferred embodiment, the actuation bar comprises a laterally protruding lug which is adapted to push upward a tab provided on the leaf spring so as to lift the leaf spring when an external force is applied to the actuation bar.

Preferably, the tab disengages itself from the lug when the leaf spring reaches the second position where the striking plate is lifted to the release position.

Preferably, the actuation bar has a front end movable along a guiding ramp when the external force is applied to the actuation bar, thus improving reliability and accuracy of the engagement between the lug of the actuation bar and the tab of the leaf spring.

Preferably, the engagement between the tab and the lug is such that the tab slides on an upper surface of the lug towards an edge of the lug when the front end of the actuation bar moves along the guiding ramp, and drops from the edge of the lug when the leaf spring reaches the second position, whereby releasing the leaf spring from the actuation bar.

BRIEF EXPLANATION OF THE DRAWINGS

The above and other features and advantages of the present invention can be understood better after reading the following detailed description of the preferred embodiment of the present invention with reference to the accompanying drawings, in which.

DETAILED DESCRIPTION OF THE PREFERRED EMBODIMENTS

Figure 1A:
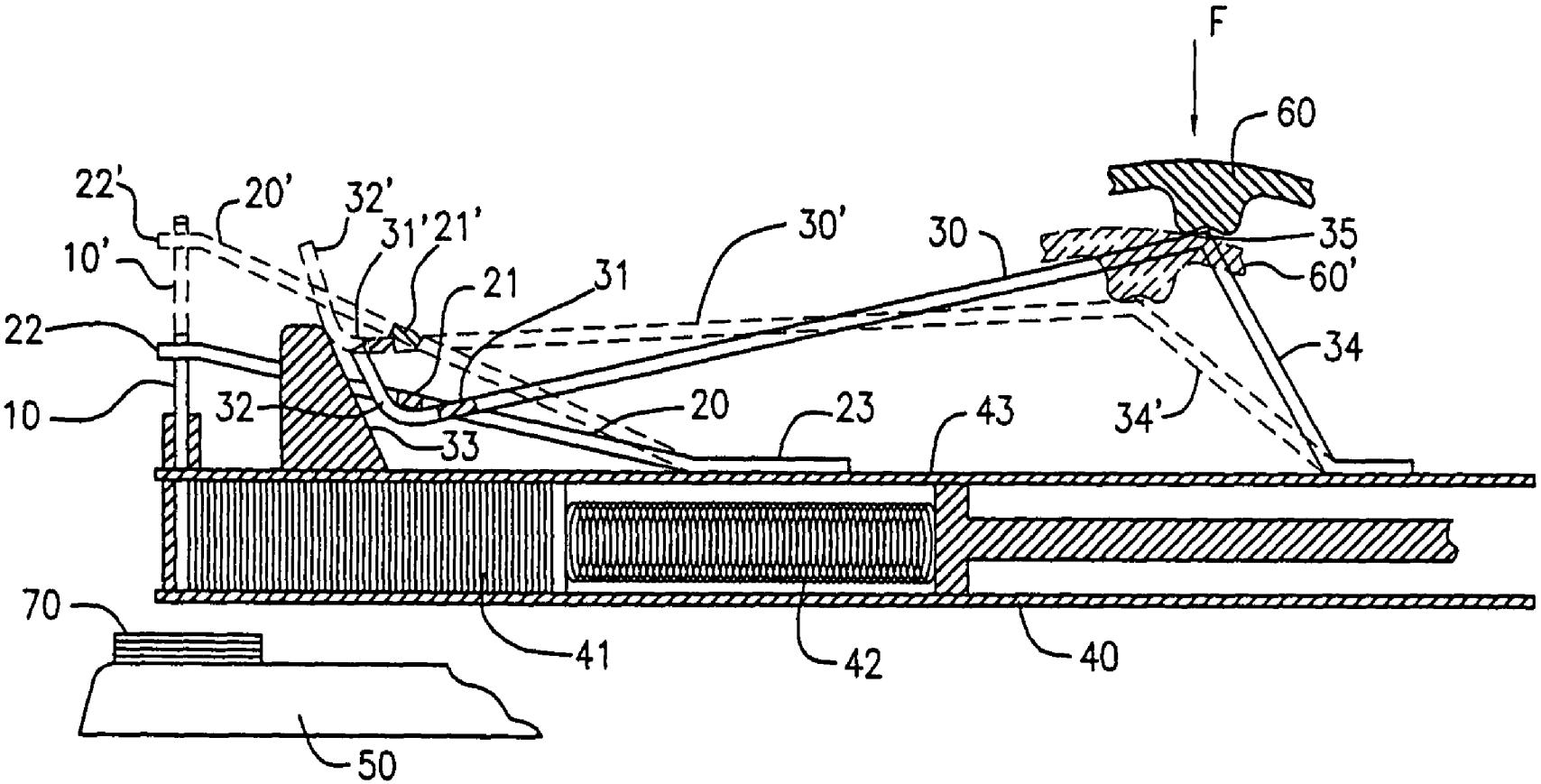
FIG. 1*a* schematically and partially illustrates a preferred embodiment of the stapler according to the present invention.

Similar to a conventional stapler, the stapler according to the present invention mainly comprises a magazine 40 for accommodating a staple stick 41, a base 50 for placing a work piece 70 (such as a stack of paper) thereon, and a cover 60 for accepting a pressing force from a user for a stapling operation, as illustrated in FIG. 1. During a stapling operation, the striking plate 10 is first lifted from an initial position to a release position (as shown in dashed line), leaving a slot space below into which a single staple is pushed from the staple stick 41 under a biasing force from the compressed spring 42. When the striking plate 10 is driven from the release position back to its initial position, the single staple is driven into the work piece 70 on the base 50 to staple the work piece 70.

The improvement of the present invention is generally in the mechanism for actuating the striking plate 10 during the stapling operation, as will be described in detail below.

As schematically illustrated in FIG. 1*a*, the actuation mechanism of the preferred embodiment of the present invention mainly comprises a leaf spring 20 for driving the striking plate 10 between the initial position and the release position, and an actuation bar 30 for lifting the leaf spring 20 from a lower position to an upper position (as shown in dashed lines) so as to lift the striking plate 10 from the initial position to the release position. As will explained in more detail below, when the leaf spring 20 reaches the upper position and therefore the striking plate 10 is brought to the release position, the leaf spring 20 is released from the actuation bar 30, and powerfully drives the striking plate 10 from the release position back to the initial position when the leaf spring returns from the upper position back to the lower position.

A front end 22 of the leaf spring 20 engages with the striking plate 10 (e.g., by a hole in the striking plate 10) so that the front end 22 of the leaf spring 20 moves together with the striking plate 10, whereby driving the striking plate 10 to move vertically between the initial position and the release position. A back end 23 of the leaf spring 20 is fixed to the magazine 40, for example, on an upper surface 43 of the housing body of the magazine 40.

When there is no external force applied to actuation bar 30, the actuation bar 30 is in an idle position, the leaf spring 20 remains in the lower position and the striking plate 10 rests in the initial position, as shown by the solid lines. During the stapling operation, the leaf spring 20 is lifted from the lower position to the upper position and brings the striking plate 10 from the initial position to the release position. At the same time, the leaf spring 20 is loaded when it is lifted upwards.

In the stapling operation, an external force ("F" in FIG. 1*a*) is applied to the actuation bar 30, e.g., by pressing on the cover 60. Under the external force, the actuation bar 30 comes into engagement with the leaf spring 20 and lifts the leaf spring 20 from the lower position to the upper position, whereby bringing the striking plate 10 from the initial position to the release position, as described above.

In the preferred embodiment illustrated in FIG. 1*a*, the actuation bar 30 has a rounded L-shaped front end 32. In the idle position, the L-shaped front end 32 is slightly apart from a ramp 33 formed on the upper surface 43 of the magazine 40. When the external force is applied to the actuation bar 30, the front end 32 is pushed forward to abut against the ramp 33 and moves upward along the ramp 33.

A pair of lugs 31 are provided on the actuation bar 30 (as best shown in FIGS. 2*a*-2*d*), which protrude laterally from the length of the actuation bar 30. When the L-shaped front end 32 is pushed forward by the external force applied to the actuation bar 30, the lugs 31 come into contact with a pair of tabs 21 (best shown in FIGS. 2*a*-2*d*). When the L-shaped front end 32 is pushed, under the external force applied to the actuation bar 30, to moves upward along the ramp 33, the lugs 31 push the tabs 21 upward, whereby lifting the leaf spring 20 toward its upper position as shown in dashed lines, and at the same time loading the leaf spring 20. Consequently, the striking plate 10 is lifted by the front end 22 of the leaf spring 20 to the release position against a biasing force from the leaf spring 20, as shown in dashed lines.

Preferably, when the front end 32 moves upward along the ramp 33, the tabs 21 are able to slide backward along an upper surface of the lugs 31. Thus, the upper surface of the lugs 31 function as a ramp for the tabs 21. In a preferred design, the lugs 31 may assume an angle (e.g., 30 degree) from a main flat body of the actuation bar 30.

When the leaf spring 20 reaches the upper position and therefore the striking plate 10 reaches the release position, the tabs 21 reach back edges 31*a* of lugs 31 and drop from the lugs 31 to disengage themselves from the lugs 31. Under the biasing force loaded in the leaf spring 20, the tabs 21 return to their initial positions (i.e., the lower position shown in solid lines), and the load in the leaf spring 20 is released, which powerfully drives the striking plate 10 from the release position to the initial position where the striking plate 10 strikes a stapler into the work piece 70.

Preferably, a biasing mechanism is provided to the actuation bar 30 so that after the external force applied to the actuation bar 30 is released, the actuation bar 30 can automatically return to its initial position (as shown in solid lines) under a biasing force. In the embodiment shown in FIG. 1*a*, the biasing force is provided by a resilient lever 34 which connects the actuation bar 30 at a back end 35 to the upper surface 43 of the magazine 40. When the actuation bar 30 moves forward under the external force applied to it through the cover 60, the resilient lever 34 is brought to bend forward and the biasing force is loaded in the resilient lever 34. When the external force is removed, the load built in the resilient lever 34 is released, and the resilient lever 34 returns to its initial position and pulls the actuation bar 30 back to its initial position as well.

Figure 1B:
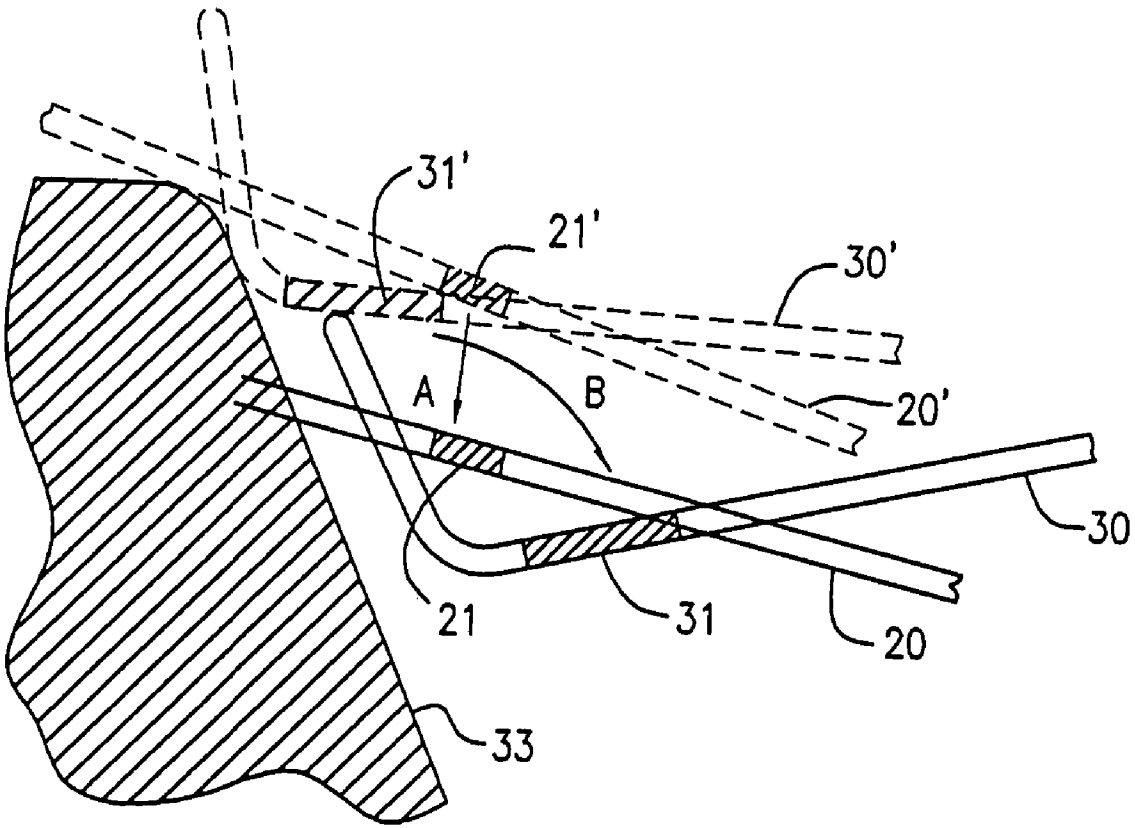
FIG. 1*b* schematically illustrates the paths of the returning movement of the lugs and tabs in FIG. 1*a*.

It is important that the lugs 31 of the actuation bar 30 are not obstructed by the tabs 21 (which have returned to their initial positions) on their way of returning to their initial positions after the external force is removed. As illustrated in FIG. 1*b*, after the external force is removed, the lugs 31 are pulled backward by the biasing force from the resilient lever 34 and move along path "B" which is not obstructed by the tabs 21 which have dropped to their initial positions from the lugs 31 along the path "A".

The engagement between the lugs 31 and the tabs 21 are illustrated more clearly in perspective views 2*a*-2*d*, which show the actuation mechanism according to the present invention in various operational stages.

Figure 2A:
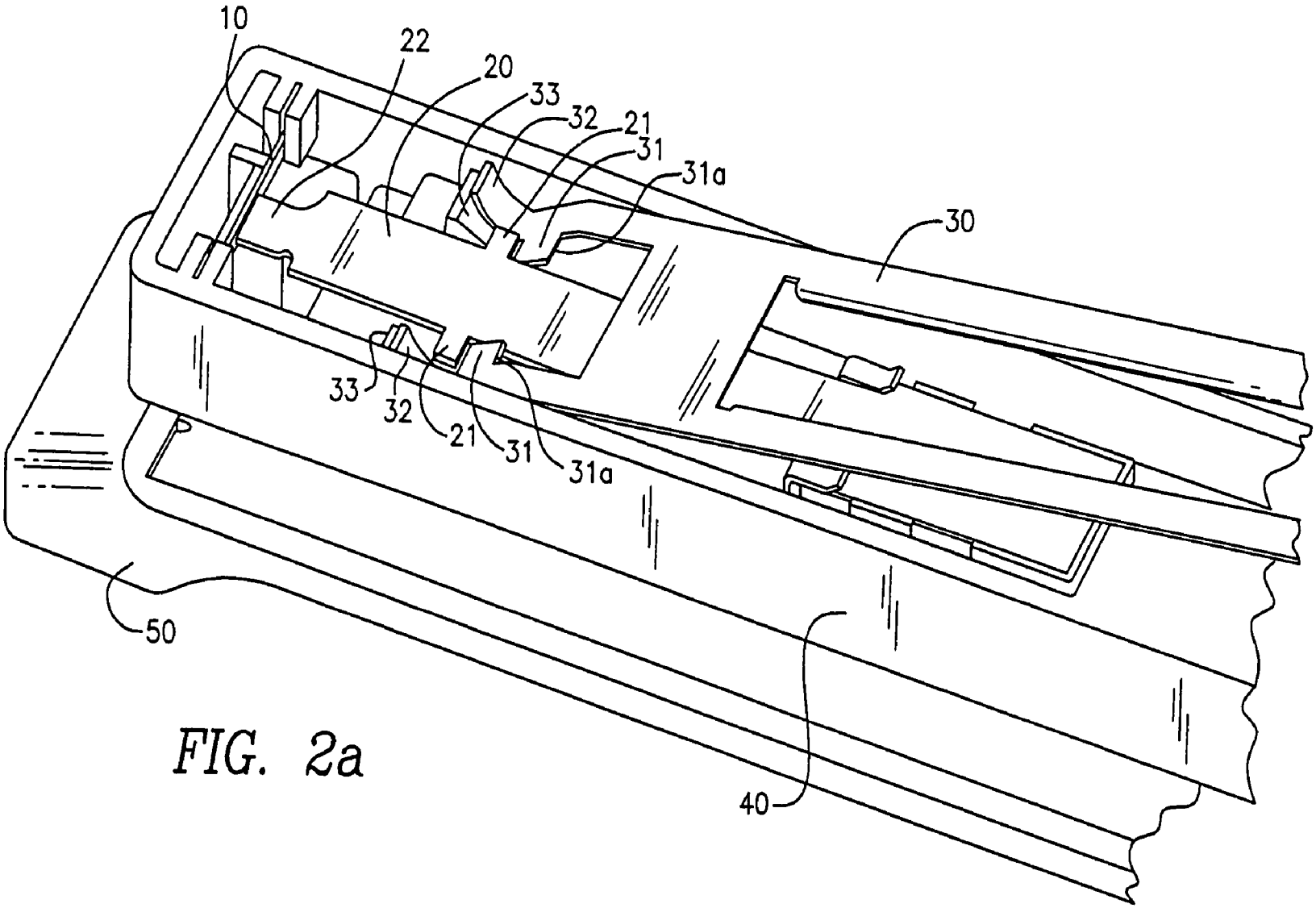
FIG. 2*a*-2*d* are partial perspective views showing the actuation mechanism of the stapler of FIG. 1 at various operational stages.

FIG. 2*a* shows the actuation mechanism in a position before or after a stapling operation, in which the actuation bar 30 rests in its initial idle position because there is no external force applied on it. The lugs 31 on the actuation bar 30 are not engaged with the tabs 21 of the leaf spring 20. The striking plate 10 rests in the initial position, and the leaf spring 20 is in the lower position.

Figure 2B:
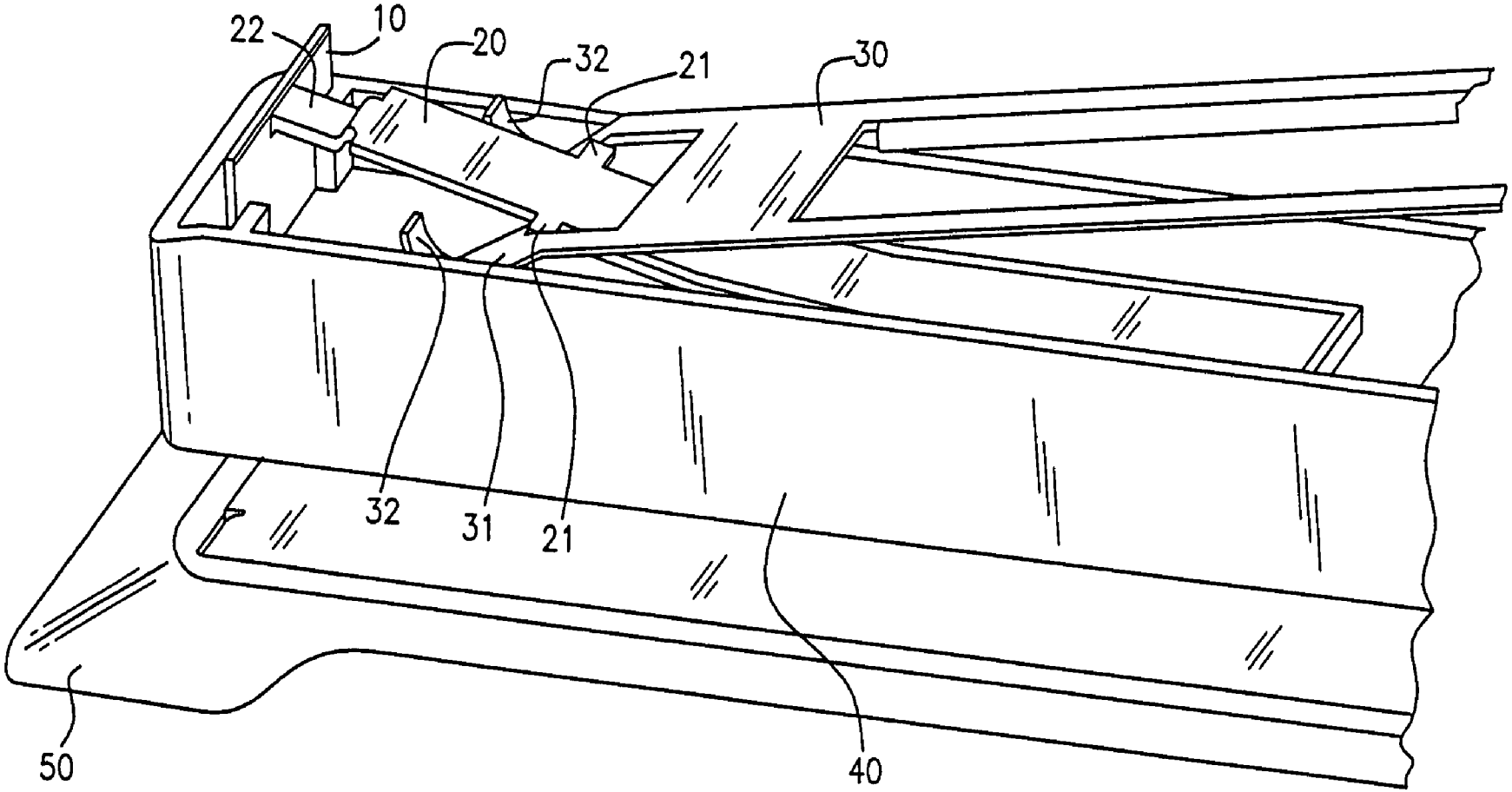
Figure 2C:
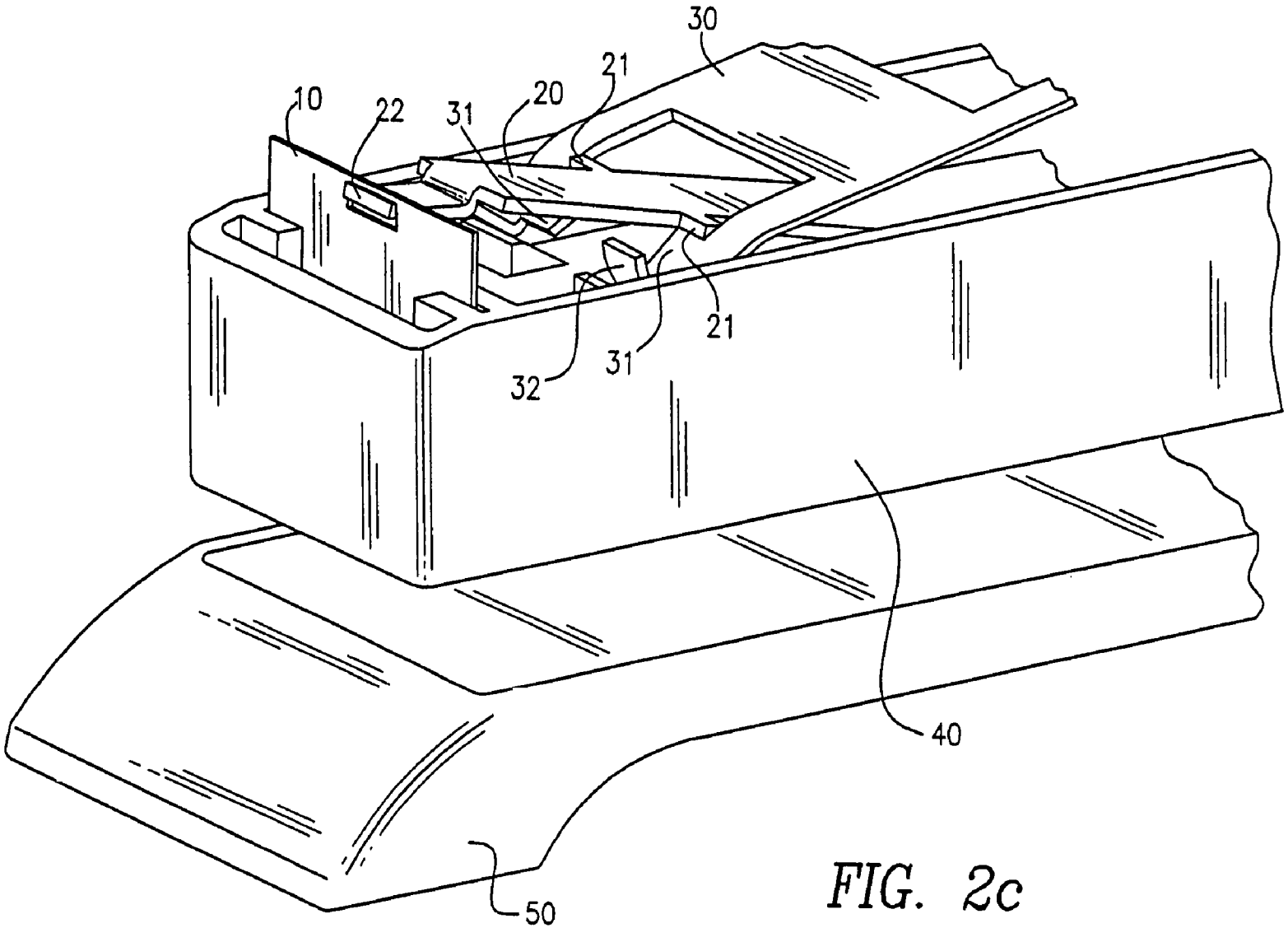

During the loading stage of the stapling operation, when the front end 32 of the actuation bar 30 is pushed forward by an external force, the lugs 31 come into engagement with the tabs 31 and push the tabs 21 upward when the front end 32 moves upward along the ramp 33, until the leaf spring 20 reaches the upper position where the striking plate 10 is lifted to the release position, as shown in FIGS. 2*b* and 2*c* in different angels of view. In this stage, the tabs 21 slide backward along the upper surface of the lugs 31 toward the back edges 31*a* of the lugs 31.

Figure 2D:
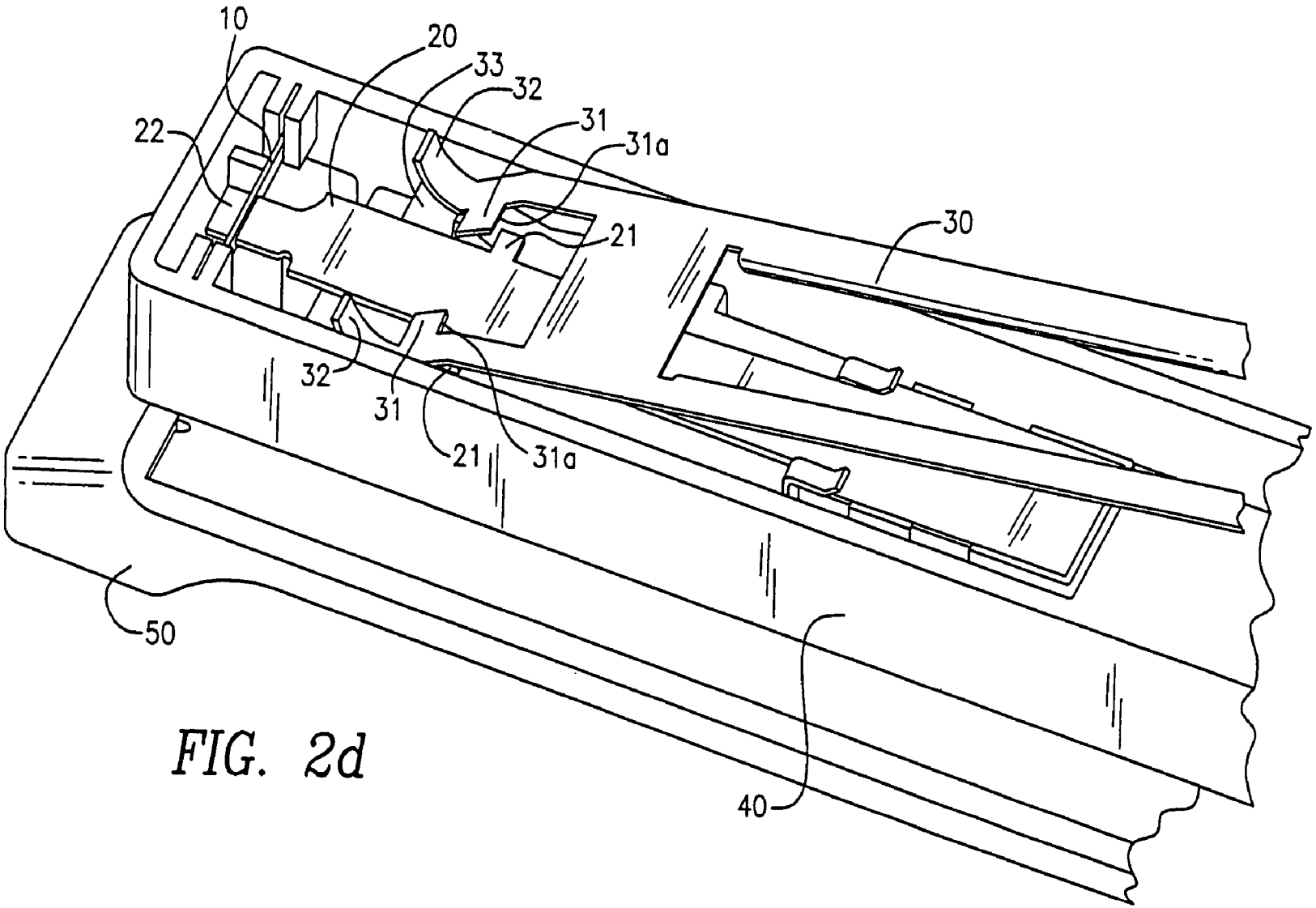

After the leaf spring 20 reaches the upper position and the striking plate 10 reaches the release position as shown in FIGS. 2*b* and 2*c*, when the L-shaped front end 32 further moves upwards along the ramp 33, the tabs 21 of the leaf spring 10 drops from the back edges 31*a* of the lugs 31 to disengage the leaf spring 10 from the actuation bar 30. Under the biasing force built in the leaf spring 20 during the loading stage, the leaf spring 20 snaps back to the lower position, and at the same time powerfully drives the striking plate 10 back to the initial position for stapling the work piece 70, as shown in FIG. 2*d*.

After the stapling operation is finished, the external force is removed from the actuatuion bar 30. Under the biasing force from the resilient lever 34 (see FIG. 1*a*), the actuation bar 30 returns to its initial position, as shown in FIG. 2*a*, and ready for a next stapling operation.

Although the above has described several preferred embodiments, it is appreciated that numerous adaptations, changes, variations and modifications are possible to a person skilled in the art without departing the spirit of the present invention. For example, the flat shaped tabs 21 may be implemented as a pair of laterally protruding rods mounted on the leaf spring 20. The resilient lever 34 can be replaced by any proper biasing mechanism for returning the actuation bar 30 toward its initial position. For example, the actuation bar 30 can also be a leaf spring with the back end 35 connected to the cover 60. Therefore, the scope of the present invention is solely intended to be defined by the accompanying claims.

What is claimed is:

1. A stapler assembly having a front and a back, said stapler comprising:

a striking plate for dispensing a staple from a staple magazine;

a leaf spring engaged with said striking plate for driving said striking plate; and an actuator operable to slide longitudinally forward along said leaf spring toward said front of said stapler, to cause said spring to be lifted, said actuator having a front end, and being operable to release the leaf spring by having an entirety of the actuator, including the front end of the actuator, move still further and exclusively forward along the leaf spring within the stapler assembly, and wherein the front end of said actuator is the end closest to said striking plate, said leaf spring having predetermined portions that contact predetermined portions of said actuator.

2. The stapler assembly of claim 1 wherein said release of said leaf spring is effected by the predetermined portions of the actuator being moved to a more forward position within the stapler assembly than the position of the predetermined portions of the leaf spring.

3. A stapler assembly having a front and a back, said stapler comprising:

a striking plate for dispensing a staple from a staple magazine;

a leaf spring engaged with said striking plate for driving said striking plate; and an actuator operable to slide longitudinally forward along said leaf spring toward said front of said stapler, to cause said spring to be lifted, said actuator having a front end, and being operable to release the leaf spring by having an entirety of the actuator, including the front end of the actuator, move still further and exclusively forward along the leaf spring within the stapler assembly, and wherein the front end of said actuator is the end closest to said striking and wherein a load bearing surface coupled to the leaf spring engages a support surface coupled to the actuator to lift said leaf spring.

4. The stapler assembly of claim 3 wherein said release of said leaf spring is effected by the load bearing surface coupled to the actuator being moved to a more forward position within the stapler assembly than the position of the support surface coupled to the leaf spring.

* * * * *